US010086994B2

(12) United States Patent
Bakke

(10) Patent No.: US 10,086,994 B2
(45) Date of Patent: Oct. 2, 2018

(54) SUBSEA STORAGE UNIT, SYSTEM AND METHOD

(71) Applicant: SUBSEA LOGISTICS AS, Leinøy (NO)

(72) Inventor: Ruben Bakke, Leinøy (NO)

(73) Assignee: Subsea Logistics AS, Leinøy (NO)

( * ) Notice: Subject to any disclaimer, the term of this patent is extended or adjusted under 35 U.S.C. 154(b) by 0 days.

(21) Appl. No.: 15/109,515

(22) PCT Filed: Dec. 4, 2014

(86) PCT No.: PCT/NO2014/050226

§ 371 (c)(1),
(2) Date: Jul. 1, 2016

(87) PCT Pub. No.: WO2015/102496

PCT Pub. Date: Jul. 9, 2015

(65) Prior Publication Data

US 2016/0325926 A1 Nov. 10, 2016

(30) Foreign Application Priority Data

Jan. 3, 2014 (NO) ..... 20140007

(51) Int. Cl.
*B65D 88/78* (2006.01)
*B63G 8/00* (2006.01)
(Continued)

(52) U.S. Cl.
CPC ..... *B65D 88/78* (2013.01); *B63C 11/00* (2013.01); *B63G 8/001* (2013.01); *B65D 88/546* (2013.01);
(Continued)

(58) Field of Classification Search
CPC .... B65D 88/78; B65D 90/0053; B65D 90/10; B65D 88/546; B63B 25/006; B63B 22/24;
(Continued)

(56) References Cited

U.S. PATENT DOCUMENTS 2,371,404 A 9/1942 Mumford
3,455,480 A 7/1969 Mitchell et al.
(Continued)

FOREIGN PATENT DOCUMENTS

CN 101 833 081 A 9/2010
EP 0 210 964 A1 2/1987
(Continued)

OTHER PUBLICATIONS

International Search Report dated Mar. 18, 2015 for International Application No. PCT/NO2014/050226.
(Continued)

*Primary Examiner* — Carib A Oquendo
(74) *Attorney, Agent, or Firm* — Knobbe, Martens, Olson & Bear, LLP

(57) ABSTRACT

Disclosed is a subsea storage unit (15; 15'; 15") including a pressure hull (1) having a cargo hold (5) configured for storing cargo (3, 7) and a base (2; 8) configured for supporting the storage unit on a seabed (B). The pressure hull has a movable hatch (4), providing access to the cargo hold. The subsea storage unit also includes suspension means (11*a,b,* 35), wherein the subsea storage unit may be lifted and lowered in a body of water, and ballasting means. A seabed facility (30), configured for receiving and accommodating at least one subsea storage unit, is also provided.

20 Claims, 12 Drawing Sheets

(51) Int. Cl.

| | |
|---|---|
| ***B65D 88/54*** | (2006.01) |
| ***B65D 90/00*** | (2006.01) |
| ***E21B 41/00*** | (2006.01) |
| ***E21B 19/00*** | (2006.01) |
| ***B63C 11/00*** | (2006.01) |
| ***B65D 90/10*** | (2006.01) |

(52) U.S. Cl.
CPC ..... *B65D 90/0053* (2013.01); *B65D 90/10* (2013.01); *E21B 19/002* (2013.01); *E21B 41/0007* (2013.01)

(58) Field of Classification Search
CPC ..... B63C 7/12; B63C 11/00; B63C 11/34; B63C 11/36; B63G 8/22; B63G 8/001; E21B 19/002; E21B 41/0007
USPC ..... 405/52, 188, 210; 114/257, 312, 318, 114/320, 321, 322, 44, 50, 51, 74, 377, 114/379, 230.2, 230.21, 230.25, 230.26, 114/230.28, 230.29, 244, 249, 314
See application file for complete search history.

(56) References Cited

U.S. PATENT DOCUMENTS

| | | | | |
|---|---|---|---|---|
| 3,625,171 | A | 12/1971 | Bailey | |
| 3,791,152 | A | 2/1974 | Davis et al. | |
| 4,426,173 | A | 1/1984 | Richart et al. | |
| 4,805,549 | A | 2/1989 | Svenning et al. | |
| 2006/0144837 | A1 | 7/2006 | Linares | |
| 2007/0089656 | A1 | 4/2007 | Baylot | |
| 2008/0041291 | A1 | 2/2008 | Horton et al. | |
| 2014/0079594 | A1* | 3/2014 | Caldeira | F17C 1/16 422/117 |
| 2015/0086299 | A1* | 3/2015 | Jamieson | B63G 8/001 414/139.6 |

FOREIGN PATENT DOCUMENTS

| | | | | |
|---|---|---|---|---|
| EP | 0 511 009 | A2 | 10/1992 | |
| EP | 2 033 890 | A1 | 3/2009 | |
| GB | 994619 | A | 6/1965 | |
| GB | 1 511 035 | A | 5/1978 | |
| GB | 2 226 352 | A | 6/1990 | |
| GB | 2 234 002 | A | 1/1991 | |
| GB | 2 365 895 | A | 2/2002 | |
| JP | H03-266794 | A1 | 11/1991 | |
| NO | 133281 | B | 12/1975 | |
| WO | WO 87/07232 | A1 | 12/1987 | |
| WO | WO 99/54235 | A1 | 10/1999 | |
| WO | 2010/030190 | A2 | 3/2010 | |
| WO | WO 2010/030190 | A2 | 3/2010 | |
| WO | WO 2013/072690 | * | 5/2013 | B63B 27/08 |
| WO | WO 2013/169115 | A1 | 11/2013 | |

OTHER PUBLICATIONS

Examination Report issued by Norway Patent Office dated Apr. 1, 2016—9 pages.
International Search Report dated Mar. 18, 2015 in the corresponding PCT application No. PCT/NO2014/050226—4 pages.
Second Written Opinion dated Dec. 3, 2015 in the corresponding PCT application No. PCT/NO2014/050226—6 pages.
International Preliminary Report on Patentability dated Apr. 8, 2016 in the corresponding PCT application No. PCT/NO2014/050226—11 pages.

* cited by examiner

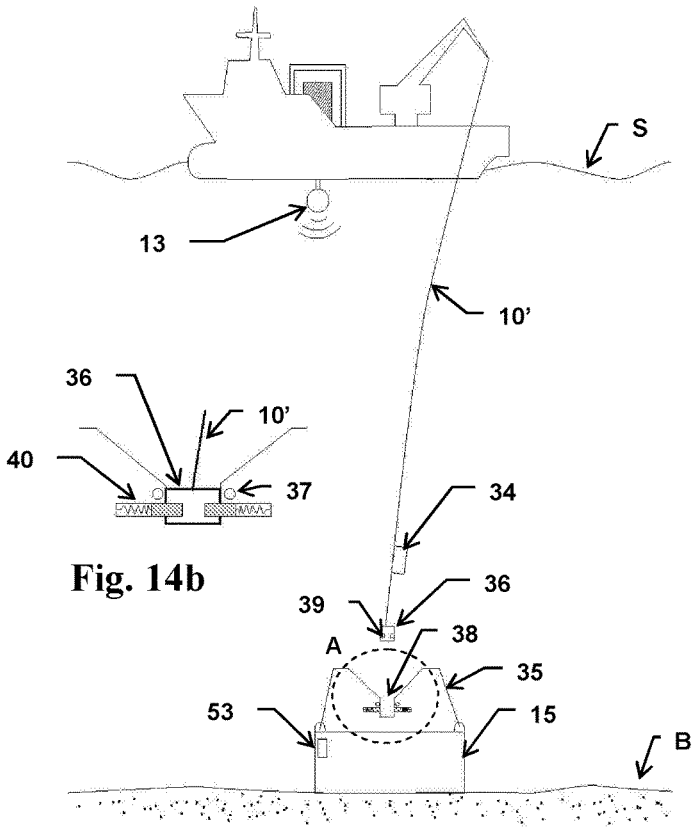
Fig. 14b
Fig. 14a
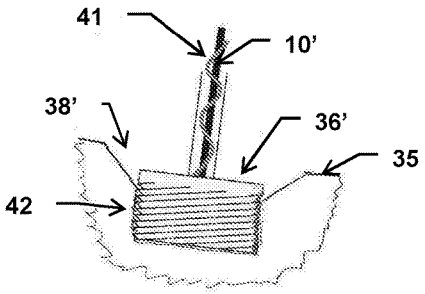
Fig. 15

SUBSEA STORAGE UNIT, SYSTEM AND METHOD

INCORPORATION BY REFERENCE TO ANY PRIORITY APPLICATIONS

This application is the U.S. National Phase of International Application No. PCT/NO2014/050226, filed Dec. 4, 2014, designating the U.S. and claiming priority to Norway Application No. 20140007, filed Jan. 3, 2014. Any and all applications for which a foreign or domestic priority claim is identified here or in the Application Data Sheet as filed with the present application are hereby incorporated by reference under 37 CFR 1.57.

FIELD OF THE INVENTION

The present invention relates to a subsea storage unit and a subsea storage system, and an associated subsea storage method.

BACKGROUND OF THE INVENTION

Exploration and production of hydrocarbons from subsea wells require various and complex equipment, such as wellhead equipment, tie-in stations, compressors and pipelines. This subsea equipment is in frequent need of maintenance, emergency repairs, and upgrade operations. In order to perform these operations, offshore workers need various tools, spare parts, etc. Offshore units, such as floating platforms, subsea vessels and anchor-handling vessels, are in general lacking in storage space, so tools and parts are normally stored onshore until they are needed offshore.

Consequently, it is necessary to be able to quickly transfer articles from land to the offshore units. As soon as the requirement for a specific article emerges at an offshore site, a request is made to an onshore supply operation. The article is then collected from the storage area and transferred by e.g. supply boats to the offshore unit, but supply boats are costly to operate and dependent on the weather. Alternatively, the subsea vessel can abort its current mission and collect articles from the onshore location, but this is also a costly and undesirable operation.

Depending on the weather, the supply boats may not be capable of handing over the articles to the offshore unit within the requested time. The timing of delivering the articles is critical, and delayed delivery of maintenance equipment to the offshore unit can be both critical and costly. It is also the case that at some onshore locations, the logistics is difficult and slow. In worst case scenarios equipment for maintaining the safety of the offshore workers will not reach the offshore unit in time.

Attempts have been made to overcome the problem of lack of offshore storage space. Examples include containers for storing articles on site, where the containers are buoyant and floating in the water. The floating containers are anchored to the seabed, making them unsuitable for extended storage due to exposure to wind, waves and currents, and adding the risk of the containers becoming detached from the anchor and colliding with offshore installations or vessels.

SUMMARY OF THE INVENTION

It is therefore provided a subsea storage unit, characterized by a pressure hull having a cargo hold configured for storing cargo, and the pressure hull having a movable hatch providing access to the cargo hold; and a base configured for supporting the storage unit on a seabed.

The subsea storage unit comprises in one embodiment suspension means, whereby the storage unit may be lifted and lowered in a body of water. In one embodiment, at least one ballast tank and control means are provided, whereby the storage unit buoyancy may be controlled. In one embodiment, the base comprises solid ballast.

The suspension means comprises in one embodiment releasable connection means.

In one embodiment, the cargo hold comprises support members configured for receiving a container, such as a standardized IMO container.

In one embodiment, the subsea storage unit comprises movable, footprint-increasing plate members that are movable between retracted and deployed positions.

The subsea storage unit may comprise localizing means, such as a transponder.

It is also provided a subsea storage system, characterized by at least one subsea storage unit according to the invention; and a seabed facility configured for receiving and accommodating at least one subsea storage unit.

It is also provided a subsea storage method, including the steps of transporting at least one subsea storage unit from an onshore location, deploying the subsea storage unit in a closed state on a seabed, locating the subsea storage unit, retrieving the subsea storage unit from the seabed to a vessel, opening the subsea storage unit in order to gain access to its cargo hold.

In one embodiment the method also comprises the step of closing and deploying the subsea storage unit.

In one embodiment the method also comprises the step of retrieving the at least one subsea storage unit from the seabed and returning it to an onshore location.

In one embodiment the subsea storage unit is deployed on a subsea facility located on the seabed, the subsea facility being configured for receiving and accommodating at least one subsea storage unit. In one embodiment, locating the subsea storage unit is provided by means of a transducer and a transponder.

The foregoing and other objects, features and advantages of the disclosure will be apparent from the following more particular descriptions of exemplary embodiments of the invention as illustrated in the accompanying figures.

BRIEF DESCRIPTION OF THE DRAWINGS

These and other characteristics of the invention will become clear from the following description of a preferential form of embodiment, given as a non-restrictive example, with reference to the attached schematic drawings, wherein:

FIG. 14*a* illustrates a docking device and a connector;

FIG. 14*b* is an enlarged view of the region A in FIG. 14*a*, with the connector locked in the docking device receptacle;

FIG. 15 is another embodiment of the docking device and the connector;

DETAILED DESCRIPTION OF THE INVENTION

Figure 1:
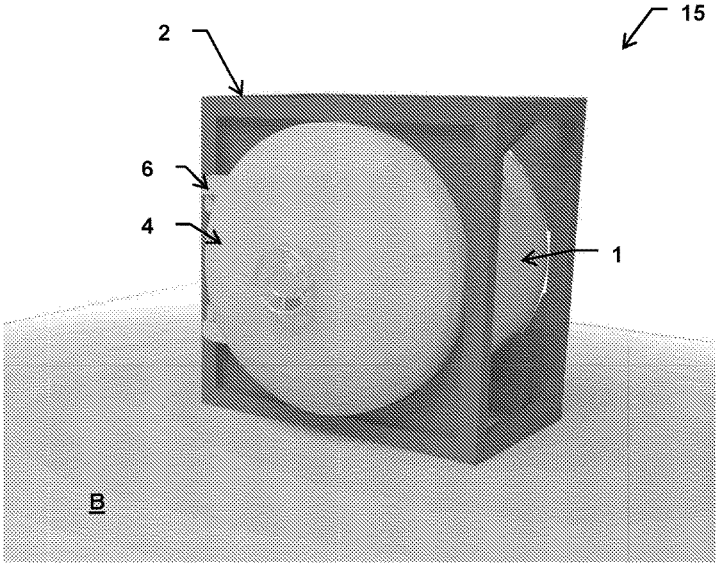
FIG. 1 is a perspective view of an embodiment of the invented storage unit in a closed state.

The following description will use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

Referring initially to FIG. 1, the invented storage unit 15 comprises a cargo housing 1 connected to a supporting structure 2. In the illustrated embodiment, the supporting structure 2 comprises a box structure that is configured for resting on a surface B. The supporting structure 2 comprises lifting means (not shown in FIG. 1), which will be described below. The box structure provides for stacking of multiple storage units.

The cargo housing 1 is a pressure hull, capable of withstanding external pressures caused by e.g. great water depths. Pressure hull design parameters are well known and need therefore not be discussed in detail here. Hence, the storage unit may be used at any water depth, by appropriate design of the pressure hull. The cargo housing may be made of one or more layers (e.g. layers of steel), such as inner and outer layers with an intermediate honeycomb structure (not shown).

The cargo housing 1 comprises a hatch 4, connected to the housing via hinges 6 and comprising conventional locking and sealing means (not shown) for providing a sealed connection between the hatch and housing when closed. The hatch may thus be opened and closed in an manner which is known in the art.

Figure 2:
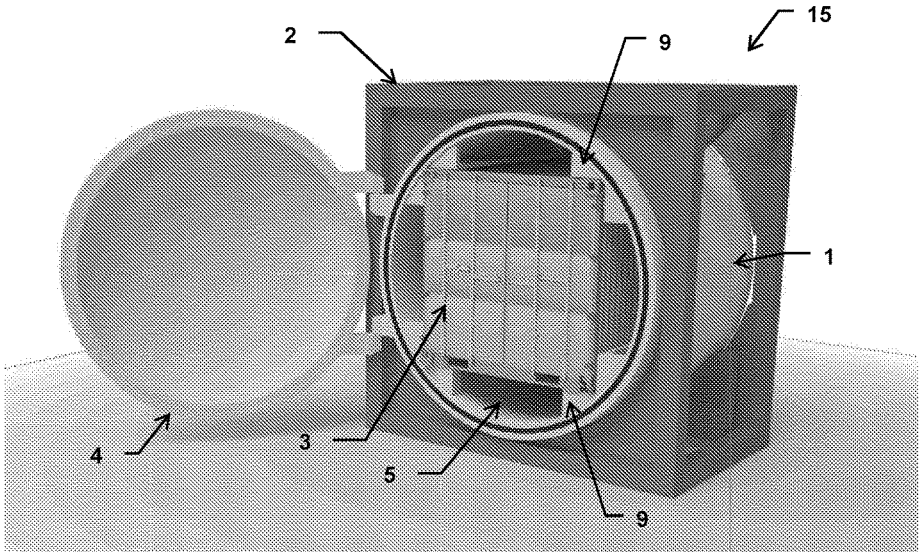
FIG. 2 is a perspective view of the storage unit shown in FIG. 1, in an open state, showing a cargo container inside the storage unit.

FIG. 2 shows the cargo housing 1 with the hatch 4 in an open position, providing access to an internal cargo hold 5. In the illustrated embodiment, the cargo hold 5 comprises support members 9 configured for supporting a cargo container 3. The support members 9 comprise rollers and locking means (not shown) that per se are known, facilitating easy insertion and retraction of the container 3. The support members 9 are configured to suit the shape of the container, e.g. a standard IMO (International Maritime Organization) container.

Figure 3:
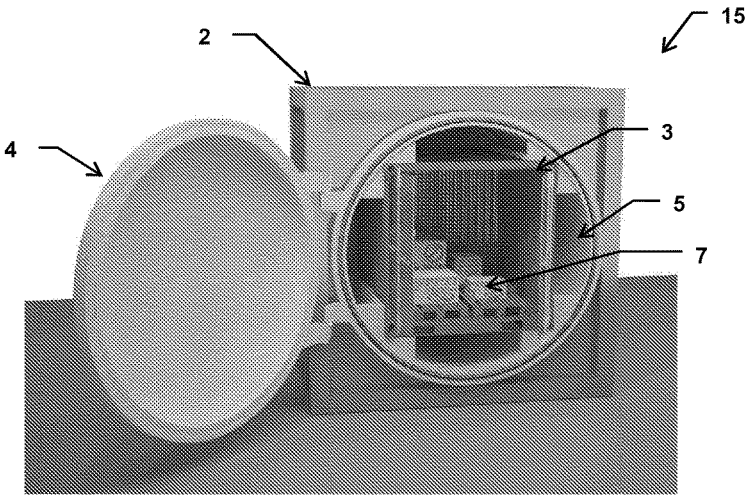
FIG. 3 is a perspective view of the storage unit shown in FIG. 2, showing also the cargo container in an open state.

FIG. 3 shows the cargo container 3 in an open state, illustrating individual cargo items 7.

The cargo items 7 may require certain environmental criteria, for example regarding pressure, humidity and salinity. The storage unit may thus be fitted with equipment (not shown) for sensing, monitoring and controlling environmental parameters within the cargo hold, e.g. in order to creating a non-corrosive environment. Such control equipment may comprise pressurized Nitrogen systems, which are known in the art, responding to sensed parameters and predetermined values.

Figure 4:
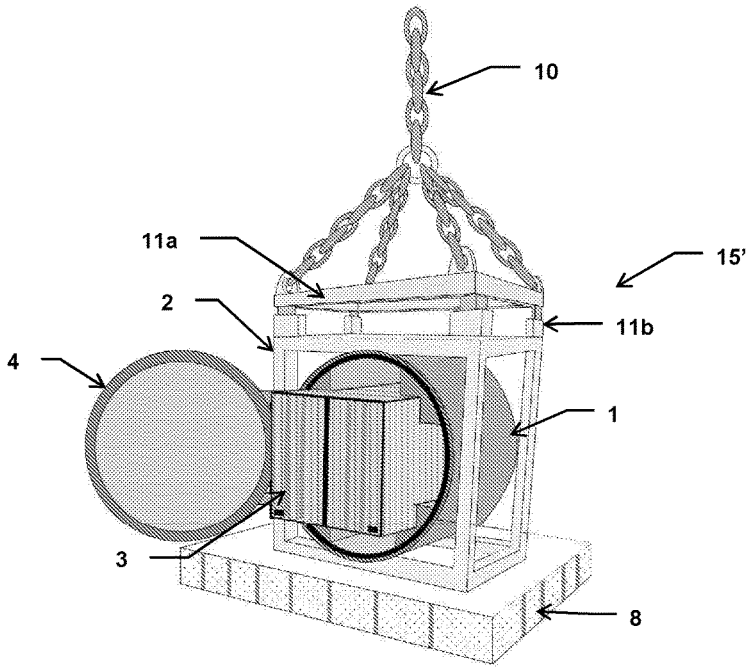
FIG. 4 is a perspective view of another embodiment of the invented storage unit, in an open state, showing a cargo container inside the storage unit.

FIG. 4 illustrates an embodiment of the storage unit 15' where a lifting frame 11*a* is connected to the supporting structure 2 via releasable locking means 11*b*. A lifting chain 10 is connected to the lifting frame 11*a*. A footing 8 is connected to the lower portion of the supporting structure 2 and provides a landing structure for the storage unit. The footing may be dimensioned so as to distribute the load in order to avoid substantial soil penetration on the seabed B. The footing 8 comprises in the illustrated embodiment a ballast material in the form of a concrete slab.

Figure 5:
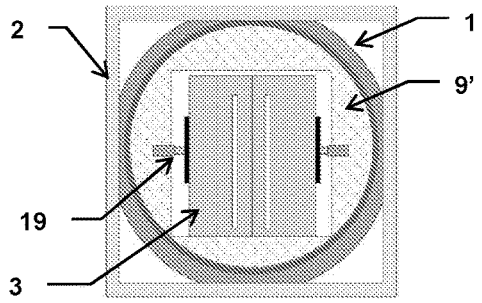
FIG. 5 is a front view of an embodiment of the invented storage unit in an open state, illustrating a container retaining device in the cargo hold.

FIG. 5 shows an alternative embodiment of the internal supporting member 9', where releasable retaining members 19 secure the cargo container 3 in place. The retaining members 19 serve to secure cargo containers in the space provided by the supporting member 9', and may comprise hydraulic or pneumatic dampers, which are known in the art.

Figure 6:
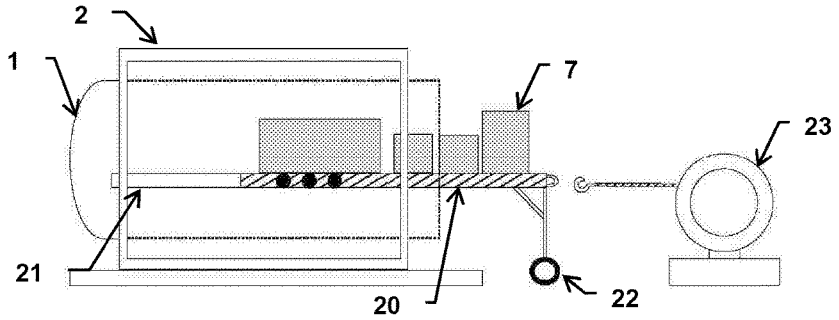
FIG. 6 is a schematic sectional drawing of an embodiment of the invented storage unit; illustrating an exemplary cargo conveyor system.
Figure 7:
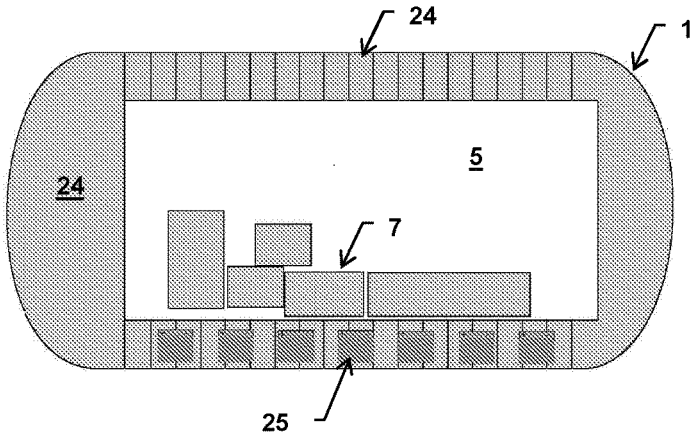
FIG. 7 is a schematic sectional drawing of an embodiment of the invented storage unit, illustrating an exemplary ballasting system.

Referring now to FIG. 6, the cargo housing comprises in an alternative embodiment a loading/unloading system for the cargo items 7. A board 20, having collapsible wheels 22, is slidably arranged on rails 21 in the housing 1. A winch 23 may be used to pull the board out of the housing 1.

FIGS. 7-10 illustrate a ballasting system for the storage unit (only the cargo housing 1 is illustrated, not its supporting structure). This system may be used together with or without the concrete ballast described above with reference to FIG. 4. The cargo housing (pressure hull) 1 comprises a number of ballast compartments 24 and ballasting pumps 25. The ballasting pumps 25 is in the illustrated embodiment powered by on-board batteries 26 (although not illustrated, the skilled person understands that the batteries are kept in a dry environment, e.g. in a watertight casing). The ballasting pumps are fluidly connected to inlet/outlet ports 27 (optionally with remotely controlled valves; not shown), whereby the ballast compartments 24 may be filled and emptied in a controlled manner. The ballasting pumps are controlled in a manner which per se is known in the art.

Figure 8:
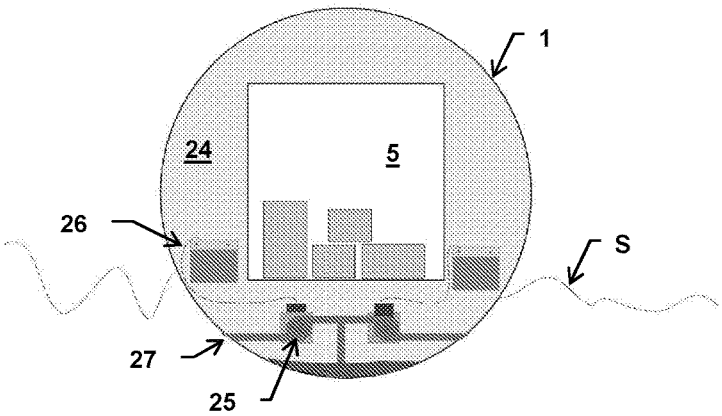
FIG. 8 is a sectional front view of the storage unit shown in FIG. 8; in a non-submerged state.
Figure 9:
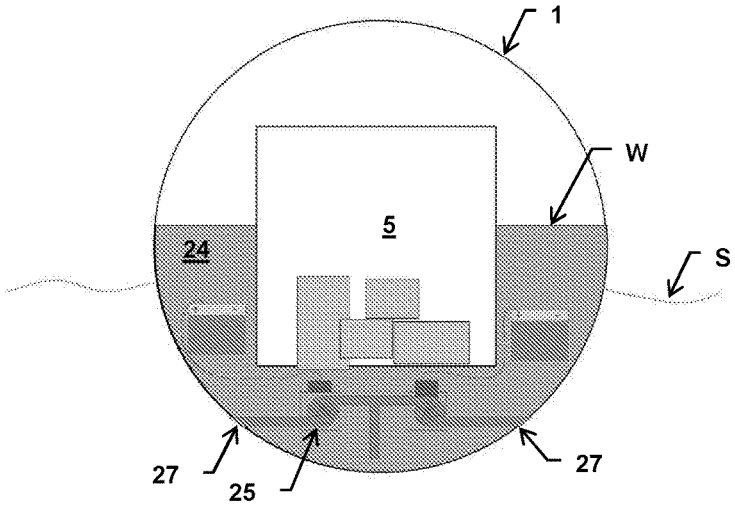
FIGS. 9 and 10 are similar to FIG. 8, but show the storage unit in partly and fully ballasted states, respectively.
Figure 10:
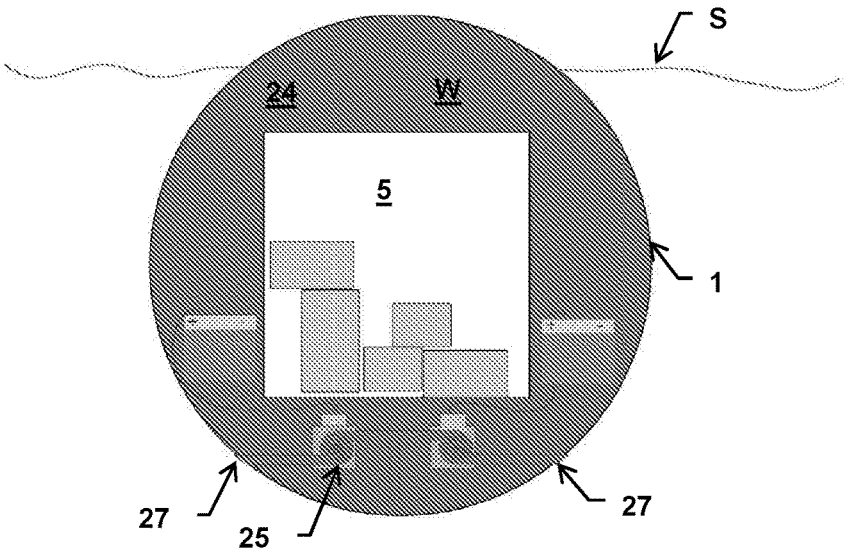

In FIG. 8, the cargo housing 1 is floating in the water surface S, and the ballast compartment 24 is virtually empty. In the illustrated embodiment, the ballast compartment 24 is enclosing the dry cargo hold 5. FIG. 9 shows and intermediate ballasting state, where the ballast compartment 24 has been partly filled with seawater W, through the ports 27. Although not illustrated, it should be understood that the ballast compartment comprises one or more ventilation valves (e.g. check valves), preferably in the upper portion of the compartment, whereby air may be evacuated as water is flowing into the compartment. In FIG. 10, the ballast compartment 24 is full. The storage unit may thus be selectively ballasted and de-ballasted by means of the ballast compartments.

Although FIGS. 7-10 illustrate the cargo housing 1 having a number of cargo items 7 in its hold 5, it should be understood that the ballasting system may also be used in the embodiment where e.g. an IMO container is arranged in the hold 5.

Figure 11:
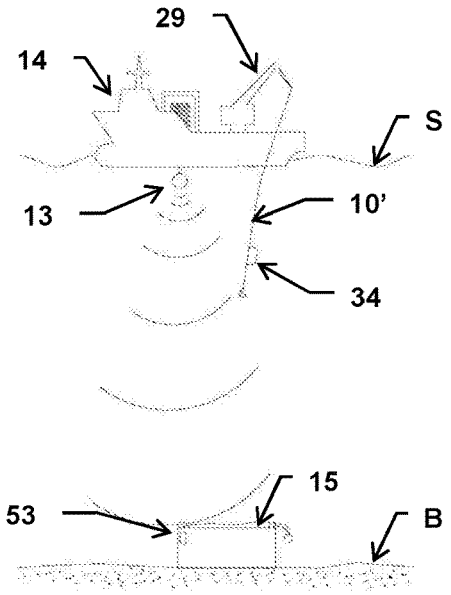
FIGS. 11 and 12 illustrate a system and a method for locating a storage unit on a seabed, and retrieving the storage unit to the surface.
Figure 12:
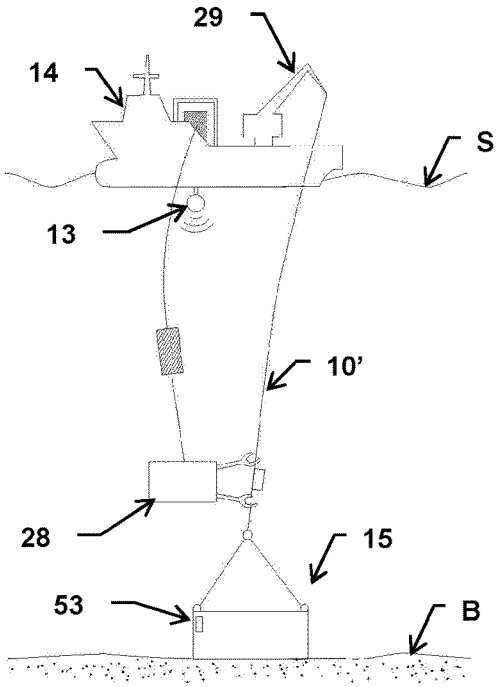

FIG. 11 illustrates a storage unit 15 arranged on a seabed B. In this configuration, the storage unit may have been ballasted by one or more of the means described above. The storage unit 15 is equipped with a transponder 53, which is well known in the art. A surface vessel 14, equipped with a crane 29, is emitting sonar signals from a transducer 13 in order to locate the storage unit 15. A lifting wire 10' is provided with a transponder 34. Each storage unit is assigned a unique identification code, whereby the surface vessel operator is able to pick the desired storage unit. The identification code may comprise information about the individual cargo items. In FIG. 12, the lifting wire 10' has been connected to the storage unit 15, by means of an ROV (Remotely Operated Vehicle) 28 and the storage unit is being hoisted to the surface by means of the crane 29. In a deployment operation, the sequence is reversed: the ROV 28 releases the lifting wire when the storage unit has been placed on the seabed.

Figure 13:
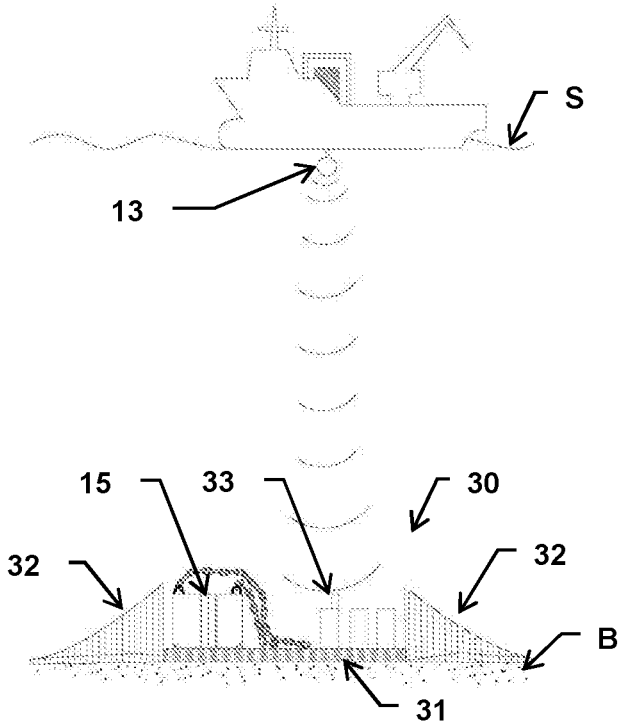
FIG. 13 illustrates a seabed depot.

FIG. 13 illustrates a seabed depot 30, which may be dimensioned for accommodating one or more storage units 15 on a foundation 31. Trawl deflectors 32 protect the storage units from dragged objects. A removable roof (not shown) may also be provided. A transponder 33 on the seabed depot 30 facilitates localizing, e.g. by the surface-borne sonar 13. The seabed depot transponder 33 may be configured to emit unique identification codes, specific to the seabed depot or/and its contents.

Information regarding the content articles in the storage units may be transmitted from the storage unit. Other information, such as operational parameters for the cargo housing may also be requested and transmitted.

FIGS. 14*a,b* and 15 illustrate an automated connection system that obviates the need for ROV or diver assisted connection and disconnection. A docking device 35 is connected to the storage unit 15 and comprises a receptacle 38 and proximity sensors 37. The receptacle comprises a plurality of spring-loaded pegs 40 and that are configured to interlock with corresponding sockets 39 in a connector 36 attached to the lifting wire 10'. The spring-loaded pegs may thus automatically interlock with the connector when it is lowered into the receptacle. FIG. 14*b* shows the connector 36 in the locked position in the receptacle. The proximity sensors 37 may also be configured to sense the presence of the connector 36, and operate the pegs accordingly. The docking device may also be remotely operated, e.g. via the above-mentioned transponders.

FIG. 15 illustrates an alternative embodiment of the connection system, where a threaded connector 36' (attached to the lifting wire 10') has been connected to the docking device 35 via corresponding threads 42 in the receptacle 38'. An umbilical 41, extending along the lifting wire from the surface vessel, provides power and control signals to an electric motor (not shown) inside the connector 36', whereby the connector may be rotated and screwed into (and out of) the threaded receptacle 38'.

Figure 16:
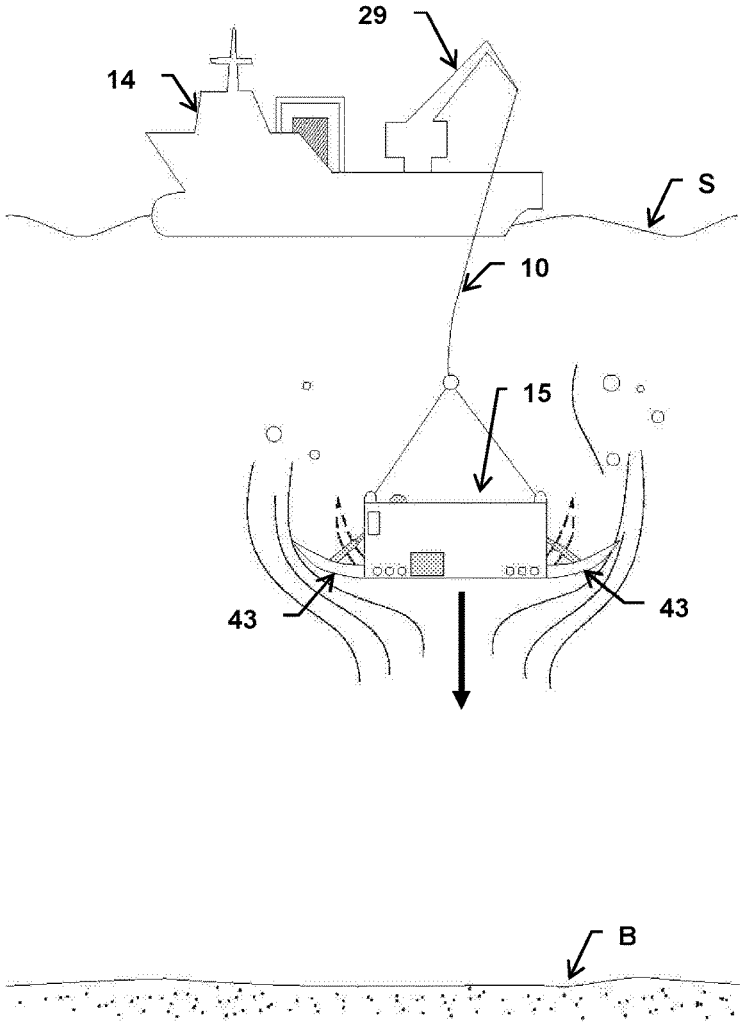
FIG. 16 illustrates an embodiment of the storage unit having deployable, footprint-increasing, plate members.

FIG. 16 illustrates a variant of the invention where the storage unit 15 is furnished with plate members 43. Each plate member is hingably connected to the storage unit and is rotatable between retracted (dotted lines) and a deployed positions. Operation of the plate members is performed by actuators (e.g. hydraulic or electrical), and the plate members may be remotely controlled or configured to operate based on local parameters (ambient pressure, seabed proximity, etc.). In a deployed position, the plate members 43 increase the storage unit lower surface area, which may tend to stabilise the storage unit as it is lowered towards the seabed, and also increase the storage unit footprint on the seabed B, thus preventing the storage unit form sinking into the seabed.

Figures 17A, 17B:
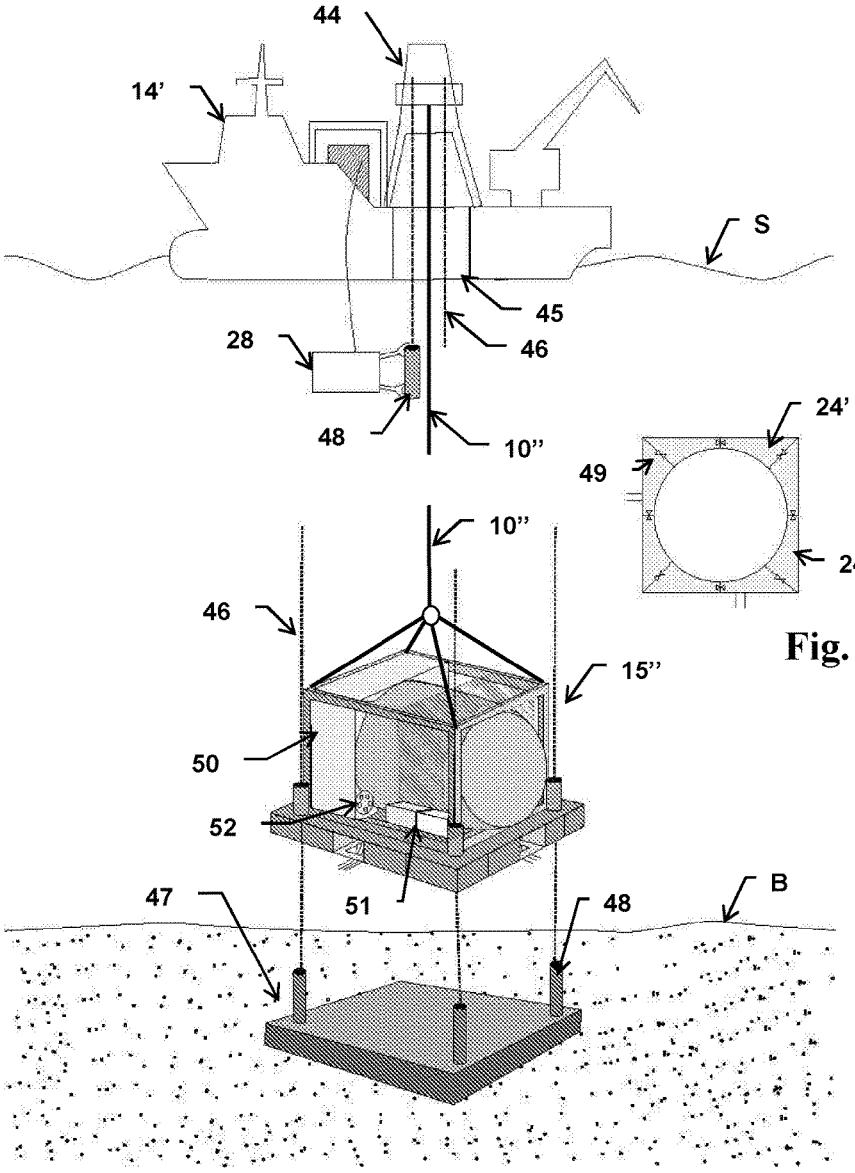
FIG. 17 illustrates a subsea template and guide wires, and a storage unit ballast system.

FIG. 17*a* illustrates another embodiment for lowering the storage unit 15" to the seabed B. An ROV 28 places guide wires 46 connected to guide posts 48 on a subsea template 47. The storage unit 15" comprises in the illustrated embodiment ballast tanks 50 with associated pumps and control systems 51, and an inlet/outlet manifold 52. The ballast tanks 50 comprise internal compartments 24' (see FIG. 17*b*) having interconnecting valves 49.

In operation, the storage unit 15" is lowered by one or more lifting wires 10" from the derrick 44, through the moon-pool 45, along the guide wires 46. The lowering may be assisted by a controlled operation of the ballast control system (distributing the ballast water within the compartments 24'), or be accomplished solely by the weight of the storage unit itself (and, optionally, cargo). Storage unit retrieval is also performed by the lifting wire 10" and a winch (not shown) in the derrick, through the moon-pool.

Although the invention has been described with reference to a cylindrical cargo housing with domed ends, it should be understood that the cargo housing may have other shapes. The shape of the cargo housing may thus deviate from a circular shape, depending on the applicable ambient water pressure.

Figure 18:
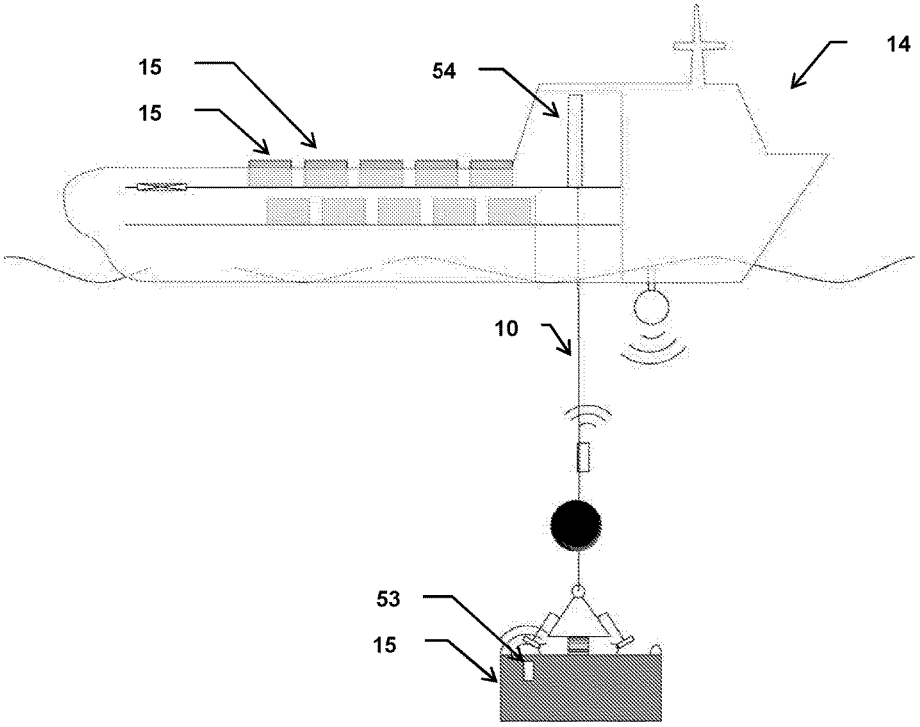
FIG. 18 illustrates a surface vessel retrieving a subsea storage unit.

FIG. 18 illustrates a surface vessel 14 with a movable crane 54 which retrieves a storage unit 15 by means of a lifting wire 10. Prior to the storage unit 15 being retrieved, the storage unit 15 has been identified and connected to the wire 10 by means previously described with reference to FIG. 11. The lifting wire can also be automatically connected to the storage unit 15 as described with reference to FIG. 14*a,b*. The movable crane 54 can be any kind of mechanism able to reel in the wire 10 and the storage unit 15, or in other ways being able to retrieve the storage unit 15. The movable crane 54 can, after retrieving, also be used to transport the storage unit 15 to a desired location on the vessel 14. The surface vessel 14 can have a vast number of storage units 15 on board, depending on the area of application. The storage units 15 may either be full of equipment, or near empty, ready to be filled with used equipment. The transponder 53 can, in addition to provide the position of the storage unit 15 and the connection means between the wire 10 and the storage unit 15, also provide information on what the storage unit 15 contains.

Figure 19:
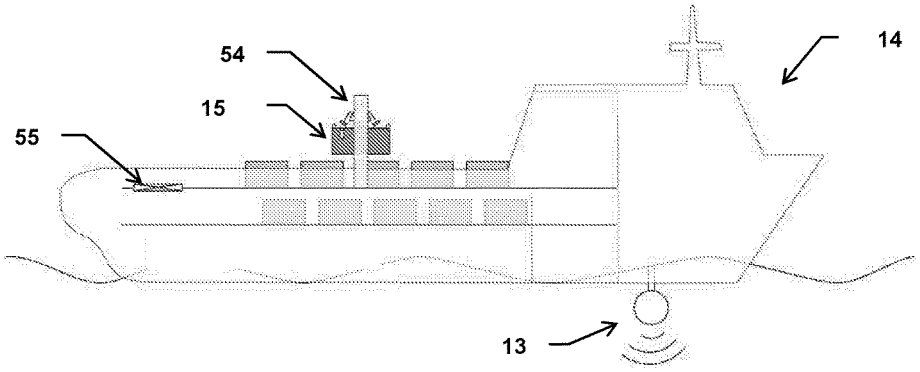
FIG. 19 illustrates a subsea storage unit being transported on a surface vessel.

FIG. 19 illustrates the storage unit 15, on board the vessel 14, being transported to a desired location by means of the movable crane 54. A logistics system on board the surface vessel 14 keeps track of which storage units contains what cargo, such a system is commonly known in the art and in handling containers on and off shore. In the figure, there is available space for the storage unit 15 below deck, so the crane 54 must transport the storage unit 15 to an opening 55 between the two decks. The device 54 which transports and distributes the storage units on the vessel 14 need not be the same device as the crane 54 which retrieves the storage units from the sea bottom, this is dependent on the logistics preferred on the vessel. While the storage unit 15 is transported to the desired location on the vessel 14, the vessel 14 can navigate to the next desired position for either retrieving or deploying more storage units. As explained above with reference to FIG. 11, the transducer 13 indicates when the vessel 14 has reached the correct position, i.e. above the next storage unit to be retrieved, or above an empty slot on the sea bed where a storage unit is to be deployed.

Figure 20:
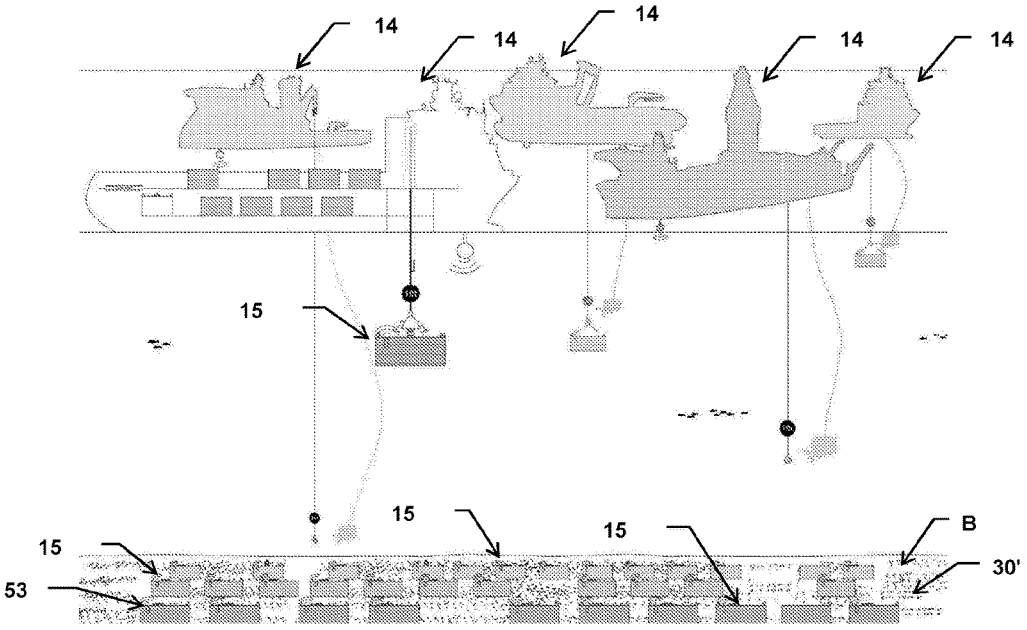
FIG. 20 illustrates several surface vessels deploying and retrieving subsea storage units from a seabed depot.

FIG. 20 illustrates how several surface vessels 14 can deploy and retrieve storage units 15 to and from a seabed depot 30' on the seabed B. Such a seabed depot 30' can simply be a designated area on the seabed B, a concrete slab or similar to facilitate storing of several storage units 15 thereupon, or a seabed depot as described with reference to FIG. 13 with trawl protection, optional roof, etc. The seabed depot 30' can cover a relatively large area, in order to allow several surface vessels 14 to operate simultaneously. The storage units 15 can either be arranged such that units with a certain content is located at one specific area on the seabed B, or the transponders 53' mounted on the storage units can provide information on what the storage units contain, as explained above with reference to FIG. 18. Systems where several storage containers are connected together, in order to allow for more efficient retrieving and deploying, is also possible. Surface vessels with different objectives can collect their desired storage unit(s) from the seabed, and return the storage unit(s) when they are done.

In order to provide efficient transport and utilization of the equipment in the storage units 15, one or more subsea supply vessels 14 can transport storage units with new or serviced equipment from an onshore location to the seabed depot 30'. When other vessels have identified and located the storage units 15, the vessels can retrieve the storage units and the content of the storage units can be utilized. If expedient, the content of the subsea storage unit can be replaced by used or damaged equipment, and the subsea storage unit 15 can be transported back to an onshore location. If the storage unit is not transported directly back to the onshore location, it can be deployed and stored on the seabed facility (30') until a vessel hauls it and transports it back to the onshore location.

What is claimed is:

1. A subsea storage system comprising:

a) a subsea storage unit, comprising:

a pressure hull having a cargo hold configured for storing a cargo, and the pressure hull having a movable hatch providing access to the cargo hold; and a base configured for supporting the subsea storage unit on a seabed, b) a docking device connected to the subsea storage unit, comprising:

a receptacle and a proximity sensor, c) a connector configured to connect to the receptacle, d) a lifting wire connected to the connector, e) a guide wire extending parallel to the lifting wire, f) a subsea template configured to be positioned on the seabed, g) a guide post connected to the guide wire, wherein the guide post is configured to connect to the subsea template, and h) a remotely-operated vehicle configured to hold the guide post, wherein the remotely-operated vehicle connects the guide post to the subsea template, wherein the proximity sensor is configured to sense presence of the connector, such that the connector is connected to the receptacle when the proximity sensor senses the presence of the connector, and wherein the connector is connected to the receptacle by the remotely-operated vehicle.

2. The subsea storage system of claim 1, wherein the subsea storage unit is configured to be lifted and lowered in a body of water.

3. The subsea storage system of claim 1, further comprising at least one ballast tank and a controller, wherein the subsea storage unit buoyancy is controlled.

4. The subsea storage system of claim 1, wherein the base comprises a solid ballast.

5. The subsea storage system of claim 1, wherein the cargo hold comprises support members configured for receiving a container.

6. The subsea storage system of claim 5, wherein the container is a standardized IMO (International Maritime Organization) container.

7. The subsea storage system of claim 1, further comprising movable, footprint-increasing plate members that are movable between a retracted position and a deployed position.

8. The subsea storage system of claim 1, further comprising a localizer.

9. The subsea storage system of claim 8, wherein the localizer is a transponder.

10. A subsea storage system according to claim 1, comprising a seabed facility configured for receiving and accommodating said subsea storage unit.

11. The subsea storage system of claim 10, the seabed facility further comprising a localizer.

12. The subsea storage system of claim 11, wherein the localizer is a seabed depot transponder.

13. The subsea storage system of claim 1, wherein the receptacle comprises a plurality of spring-loaded pegs, and the connector comprises sockets, wherein the plurality of spring-loaded pegs are interlocked with the sockets in order to connect the connector to the receptacle.

14. The subsea storage system of claim 1, wherein the receptacle is a threaded receptacle, and the connector is a threaded connector, wherein the threaded receptacle is connected to the threaded connector when the connector is connected to the receptacle.

15. The subsea storage system of claim 14, further comprising a umbilical extending along the lifting wire, and the threaded connector further comprises an electric motor, wherein the umbilical provides power and a control signal to the electric motor of the threaded connector, whereby the threaded connector is rotated and screwed to connect the connector to the receptacle.

16. A subsea storage method, comprising:

a) transporting a subsea storage unit and a docking device from an onshore location to a vessel;

wherein the subsea storage unit, comprising:

a pressure hull having a cargo hold configured for storing a cargo, and the pressure hull having a movable hatch providing access to the cargo hold; and a base configured for supporting the subsea storage unit on a seabed, and the docking device connected to the subsea storage unit, comprising:

a receptacle and a proximity sensor, wherein the vessel comprising:

a lifting wire extending from the vessel to the docking device, wherein the lifting wire has a connector at one end of the lifting wire, a guide wire extending along the lifting wire, wherein the guide wire has a guide post at one end of the guide wire, a remotely-operated vehicle configured to hold the guide post, b) positioning a subsea template on the seabed, wherein the guide post is connected to the subsea template by the remotely-operated vehicle, c) lowering the subsea storage unit and the docking device to the seabed along the guide wire, and locating the subsea storage unit and the docking device on the subsea template;

d) retrieving the subsea storage unit and the docking device from the seabed to the vessel;

e) opening the subsea storage unit in order to gain the access to the cargo hold, wherein the connector configured to connect to the receptacle of the docking device, wherein the proximity sensor is configured to sense presence of the connector, such that the connector is connected to the receptacle when the proximity sensor senses the presence of the connector, and wherein the connector is connected to the receptacle by the remotely-operated vehicle.

17. The subsea storage method of claim 16, further comprising:

closing the subsea storage unit before deploying the subsea storage unit.

18. The subsea storage method of claim 16, further comprising:

returning the subsea storage unit to the onshore location after retrieving the subsea storage unit and the docking device from the seabed.

19. The subsea storage method of claim 16, wherein the subsea storage unit is deployed on a subsea facility located on the seabed, and the subsea facility is configured for receiving and accommodating the subsea storage unit.

20. The subsea storage method of claim 16, wherein the subsea storage unit and the docking device are located on the seabed by a transducer and a transponder.

* * * * *